US005588913A

United States Patent [19]

Hecht

[11] Patent Number: 5,588,913

[45] Date of Patent: Dec. 31, 1996

[54] GAMING SYSTEM AND PROCESS FOR GENERATING CARD FACES

[76] Inventor: Allen R. Hecht, 13360 Meadow Wood La., Granada Hills, Calif. 91344

[21] Appl. No.: 259,387

[22] Filed: Jun. 14, 1994

[51] Int. Cl.[6] ..... A63F 9/24

[52] U.S. Cl. ..... 463/19; 273/237; 273/269

[58] Field of Search ..... 273/138 R, 138 A, 273/139, 269, 237; 283/903; 463/19

[56] References Cited

U.S. PATENT DOCUMENTS

| | | |
|---|---|---|
| 4,332,389 | 6/1982 | Loyd, Jr. et al. . |
| 4,365,810 | 12/1982 | Richardson . |
| 4,378,940 | 4/1983 | Gluz et al. . |
| 4,624,462 | 11/1986 | Itkis . |
| 4,747,600 | 5/1988 | Richardson . |
| 4,798,387 | 1/1989 | Richardson . |
| 4,848,771 | 7/1989 | Richardson . |
| 4,856,787 | 8/1989 | Itkis . |
| 5,007,649 | 4/1991 | Richardson . |
| 5,043,887 | 8/1991 | Richardson . |
| 5,072,381 | 12/1991 | Richardson et al. . |

*Primary Examiner*—Sebastiano Passaniti
*Assistant Examiner*—Michael O'Neill
*Attorney, Agent, or Firm*—Kelly, Bauersfeld & Lowry

[57] ABSTRACT

A process is provided for generating a plurality of gaming card arrays, each formed of a plurality of symbols positioned in predetermined symbol display locations, in a plurality of remote devices connected to a main station. The process includes the steps of developing a plurality of seeds to be utilized as input for generating gaming card arrays, and generating, at each remote device, gaming card arrays in accordance with input received from the main station, utilizing a pseudo-random number generator seeded by at least a portion of the plurality of seeds. In one preferred form, a pre-processor is utilized to screen potential seeds and save only those capable of creating unique gaming card arrays in a seed list. The seed list is then accessed when needed and seeds, together with other operational data, are transferred to the remote devices whereat the gaming card arrays are created and stored for use. In another embodiment, a pre-processor generates a plurality of secondary seeds from a predetermined list of primary seeds, screens the secondary seeds to determine which will produce unique gaming card arrays, and stores those which will not create unique arrays in a duplicate secondary seed list. The duplicate secondary seed list is then accessed, when needed, in order to eliminate the possibility of creating duplicate arrays within a remote device. A system for processing win patterns is also provided.

37 Claims, 7 Drawing Sheets

GAMING SYSTEM AND PROCESS FOR GENERATING CARD FACES

BACKGROUND OF THE INVENTION

This invention relates to electronic gaming devices. More specifically, the present invention relates to a process for generating a plurality of gaming card arrays, each formed of a plurality of symbols positioned in predetermined symbol display locations, in a plurality of remote devices connectable to a main station.

Gaming cards are used in bingo and similar games of chance, wherein the individual elements of the cards are covered by respective players pursuant to numbers generated by a random number generating device, as by drawing numbers from a hat. In bingo, for example, the gaming card is in the form of, normally, a 5×5 array of numbers, with the centermost location being blank or termed a "free space". The game is generally played with 75 or 90 numbers, where each column in the array is limited to one-fifth of the numbers: e.g., if the selected numbers are to range from 1 to 75, then the first column numbers are taken from the group 1 to 15; and if the selected numbers are to range from 1 to 90, then the numbers in the first column will range from 1 to 18. In a similar fashion, the second column of numbers are taken from the group 16 to 30 or the group 19 to 36, as the case may be, and so on. There are no duplicate numbers on the gaming card.

Before the commencement of a game, the operator specifies what constitutes a winning pattern on the gaming card. The specified pattern may be in the form of an X, T, L, a diagonal line, a horizontal line, a vertical line, four corners, and so on. Game participants attempt to achieve the specified pattern by matching the randomly-drawn numbers with the numbers on their game cards.

For instance, in one game a winning pattern may be a diagonal line and the randomly-drawn number may be in the range from 1 to 75. If a number drawn coincides with a number on the player's board, the player marks the position on his board. The first player to have board markings which coincide with the winning pattern is the winner of the game.

Several of these games, normally between 12 and 18, constitute a bingo program or session. Such an event is normally played over the course of several hours. Aside from an occasional intermission, the games are usually played consecutively and without significant interruption.

Historically, these games have been played with gaming cards formed of paper boards containing printed numerical arrays. These gaming cards are distributed at the beginning of a gaming session. Players select from a large number of boards, and will often play a number of boards during a single game.

Electronic gaming boards have been developed to overcome limitations inherent in traditional paper bingo cards, and also to enhance play where bingo players may want to play a greater number of cards simultaneously. The electronic boards can display the shape of the winning pattern to be formed from randomly-called numbers and signal the player when a winning array has been achieved. See, for example, U.S. Pat. Nos. 4,365,810; 4,848,771; 4,798,387; 4,747,600 and 5,043,887, the disclosures of said patents being expressly incorporated herein by reference.

Even with the improvements brought about by electronic gaming boards, the play during a bingo gaming session has become much more complex. More and different types of games are being played today than just the five across, up or down of the traditional bingo game. Specialized win patterns for each game are becoming commonplace, and it is difficult to provide a multiplicity of patterns on electronic gaming boards by using individual select switches because of the large number of possible patterns.

Often times there are multiple win patterns or levels that build to a final payoff. For example, the final win pattern may be three completely filled horizontal bars comprising the first, third and fifth rows of a card. The first level win pattern may be the fifth row, the second level win pattern may be the fifth and first rows, and the third level win pattern or final payoff is given to the first player to completely fill all three bars.

Game participants will generally play several game cards at a time. It is advantageous to the operator of a gaming session to accommodate such inclination in order that he may sell as many game cards as possible, but additional game cards create control and audit problems. Previously, the operator of a gaming session has been without any knowledge of the actual cards being used by the respective participants. Moreover, the participants must locate entries on a number of cards and simultaneously watch for the winning pattern. If the winning pattern varies from game to game, the task can become truly formidable, resulting in an inefficient gaming operation. To retain control, the operator of the gaming session must be able to maintain an accurate record of the cards which have been sold throughout the course of an evening.

The increased volume of card sales demands a more efficient distribution mechanism. Existing electronic gaming boards require players to input numbers laboriously into their gaming boards, or to wait as a random number generator fills their cards. This procedure is time-consuming, precluding additional card sales. Many of these needs have been addressed in the disclosure found in U.S. Pat. No. 5,043,887.

There is a continuing need, however, for electronic gaming boards which provide quick and easy means by which the gaming operator can provide large numbers of gaming cards, as well as complex gaming schedules, to gaming boards. A gaming system which is designed to improve the efficiency of a typical bingo gaming session should provide gaming boards which cannot be changed. Furthermore, the boards should be designed for quick, easy verification of winning claims. In order to more efficiently load gaming cards into a gaming board, it would be preferable to eliminate unneeded tasks now performed at the main station or central processing unit, and delegate those tasks, to the extent possible, to be performed at the individual gaming boards themselves. The present invention fulfills these needs and provides other related advantages.

SUMMARY OF THE INVENTION

The present invention resides in a novel process for generating a plurality of gaming card arrays, each formed of a plurality of symbols positioned in predetermined symbol display locations, in a remote device connected to a main station. The process comprises, generally, the steps of developing a plurality of seeds to be utilized as input for generating gaming card arrays, and generating, at the remote device, gaming card arrays in accordance with input received from the main station utilizing a random number generator seeded by at least a portion of the plurality of seeds.

In accordance with one aspect of the invention, the developing step includes the steps of creating the seeds utilizing a first pseudo-random number generator at the main station, verifying that each seed is not a duplicate of a previously created seed, and sending the seeds, less duplicates, to the remote device. A parameter file is updated to maintain a record of which seeds have been used, for utilization during the verifying step, and the seeds sent from the main station are stored in a temporary table at the remote device. The generating step includes the steps of accessing the temporary table after each new gaming card array is generated, determining if any unused seed remains in the temporary table and, if so, generating another new gaming card array utilizing the unused seed. A schedule of play as well as non-resident win patterns may be sent from the main station to the remote device.

One preferred form of the invention comprises the steps of developing a seed list in a memory of the main station, transferring at least a portion of the seed list to a plurality of remote devices, and creating, at the remote devices, gaming card arrays utilizing a pseudo-random number generator seeded by the transferred portion of the seed list. More specifically, the transferring step includes the step of ensuring that seeds transferred to any one remote device do not duplicate the seeds transferred to any other remote device. The developing step includes the steps of creating a plurality of seeds for the seed list utilizing a pseudo-random number generator at the main station, and verifying that each seed is not a duplicate of a previously created seed. A gaming card array is generated from each unique seed created, and the developing step further includes the steps of verifying that each gaming card array is not a duplicate of a previously generated gaming card array, and saving the seeds resulting in unique gaming card arrays in the seed list. Each unique card array is saved in a temporary file which is accessed during the verifying step.

A parameter file at the main station is updated to maintain a record of the seeds transferred to each remote device. The transferred portion of the seed list is stored in a temporary table which is accessed by a pseudo-random number generator at the remote device to generate the gaming card arrays. The pseudo-random number generators at each remote device and at the main station always generate the same gaming card array for any given seed. The creating step includes the steps of accessing the temporary table after each new gaming card array is generated, determining if any unused seed remains in the temporary table and, if so, generating another new gaming card array utilizing the unused seed.

A second preferred process comprises the steps of processing a primary seed to create a list of duplicate secondary seeds, storing the duplicate secondary seed list in a main station, sending operational data including the duplicate secondary seed list from the main station to at least one remote device, and generating at the at least one remote device, gaming card arrays utilizing the primary seed.

In this embodiment, the processing step includes the steps of creating a plurality of secondary seeds from the primary seed, and verifying that each secondary seed is not a duplicate of a previously created secondary seed. Each unique secondary seed is saved in a temporary secondary seed list, and then a gaming card array is generated for each non-duplicate secondary seed. The gaming card arrays are checked for duplicates, and then each unique gaming card array is saved in a temporary gaming card array file.

The generating step includes the steps of seeding a first pseudo-random number generator with the primary seed to create a plurality of secondary seeds, and generating the gaming card arrays utilizing a second pseudo-random number generator seeded by at least a portion of the plurality of secondary seeds. Each secondary seed is compared with the list of duplicate secondary seeds, and all duplicate created secondary seeds are withheld from the second pseudo-random number generator.

The process may include the step of sending an offset, if required, from the main station to the remote device. In this instance, the generating step includes the step of withholding from the second pseudo-random number generator a number of the unique created secondary seeds corresponding to the offset sent to the remote device with the operational data. A parameter file is updated to record the quantity of gaming card arrays to be generated in the at least one remote device. The gaming card arrays created at the at least one remote device are stored in a gaming card array table.

In one variation of the second preferred process of the invention, the step of seeding the first pseudo-random number generator with the primary seed includes the step of retrieving the primary seed from a memory storage location in the main station. Preferably, the primary seed is chosen from a list of prime numbers. In a second variation of the second preferred process of the present invention, the step of seeding the first pseudo-random number generator with the primary seed includes the step of retrieving the primary seed from the at least one remote device. Here, the remote device serial number is adopted as the primary seed.

Other features and advantages of the present invention will become apparent from the following more detailed description, taken in conjunction with the accompanying drawings which illustrate, by way of example, the principles of the invention.

BRIEF DESCRIPTION OF THE DRAWINGS

The accompanying drawings illustrate the invention. In such drawings.

DETAILED DESCRIPTION OF THE PREFERRED EMBODIMENTS

Figure 1:
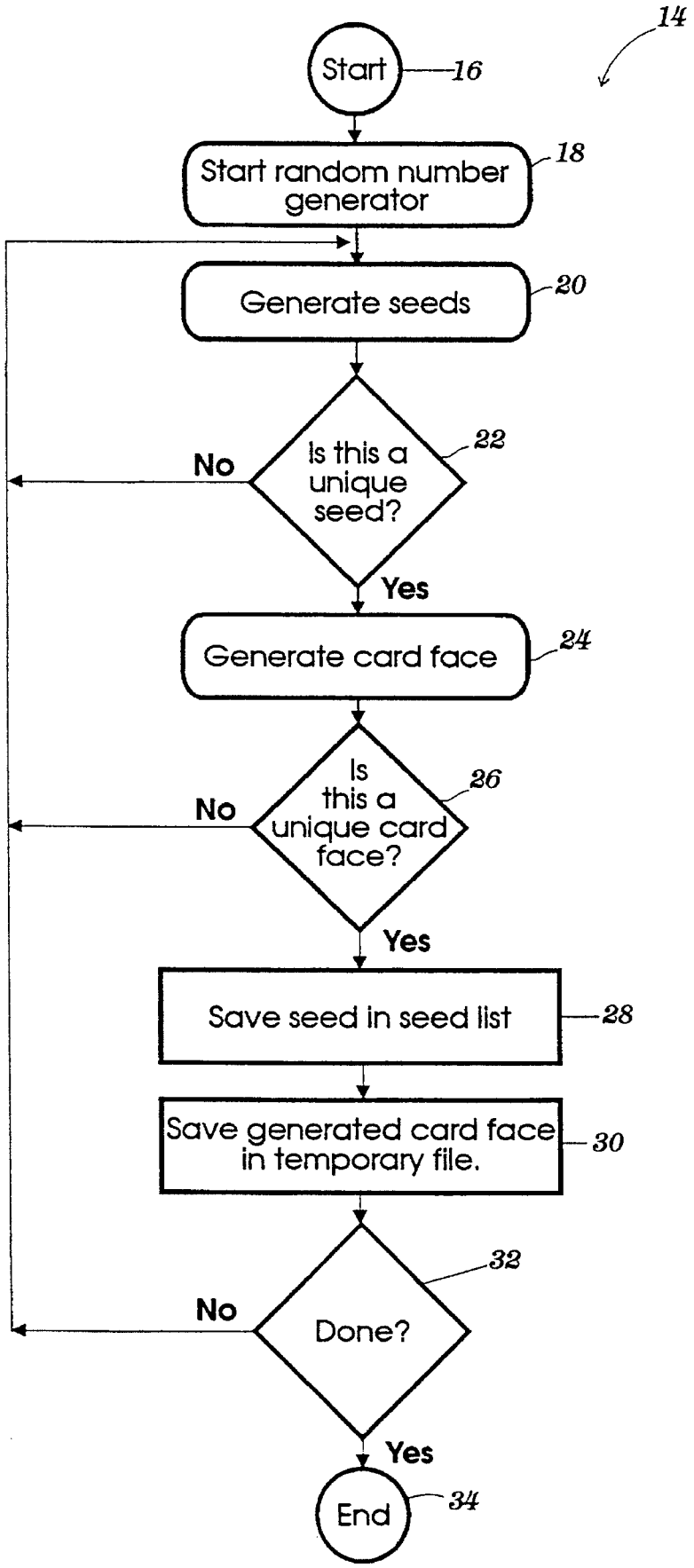
FIG. 1 is a flow chart illustrating the steps taken in a pre-processor to generate seeds which are stored in a file in a main station for later access by and transmission to a plurality of remote devices, in accordance with one preferred form of the invention.

As shown in the drawings for purposes of illustration, the present invention is concerned with a computerized process for generating a plurality of gaming card arrays, each formed of a plurality of symbols positioned in predetermined symbol display locations, in a remote device 10 connected to a main station 12. With specific reference to the game of bingo, current technology embraces systems that transfer bingo faces from a library that is stored in a computer system to an electronic device (handset) that aids people who are playing bingo. In contrast, the process of the present invention creates the bingo cards in the handset or remote device 10, thereby eliminating the need to maintain a library of gaming card arrays or bingo faces in the computer system or main station 12.

Figure 2:
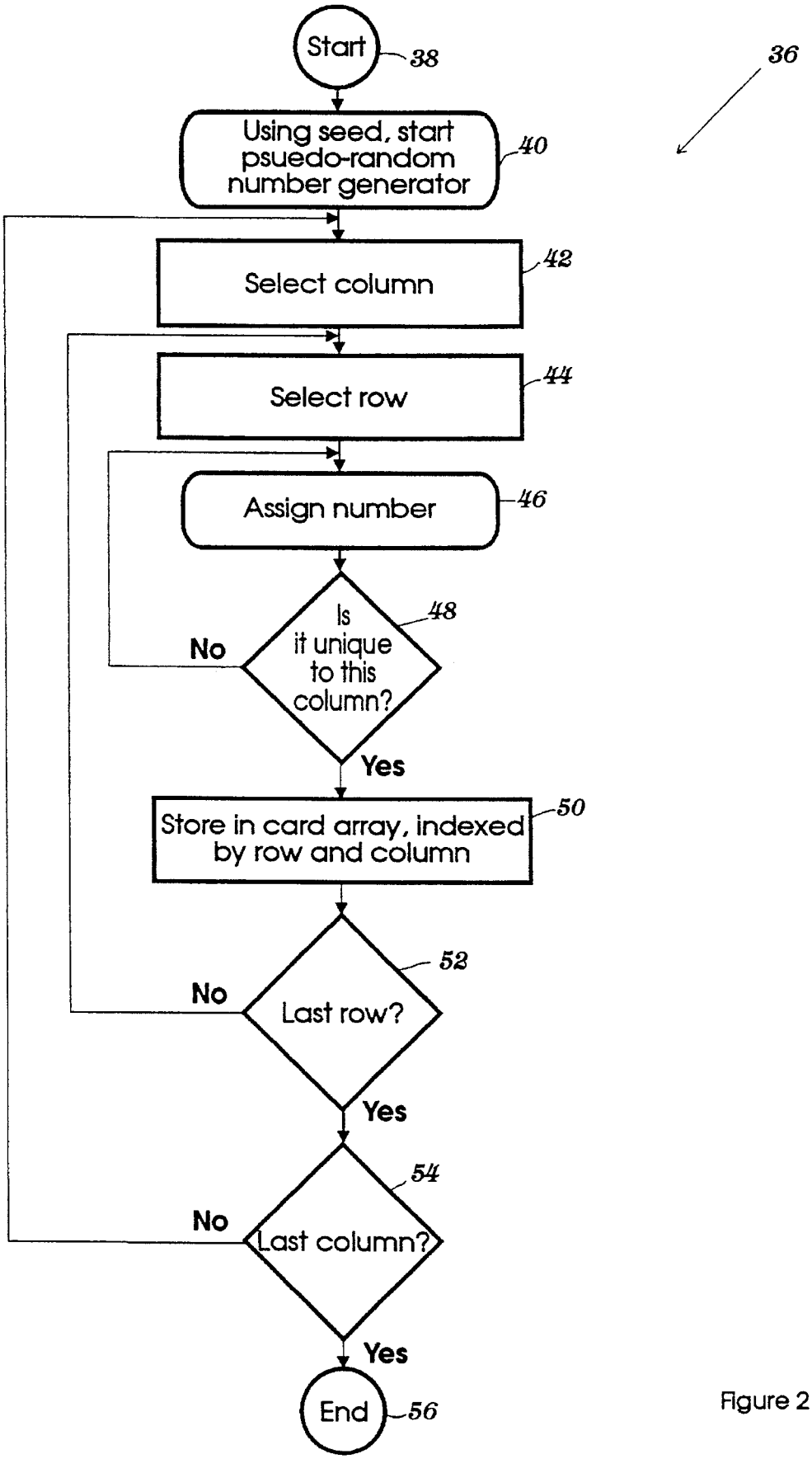
FIG. 2 is a flow chart illustrating the steps taken to generate a gaming card array, and specifically a bingo card, utilizing seeds generated, for example, during the process shown in FIG. 1.
Figure 3:
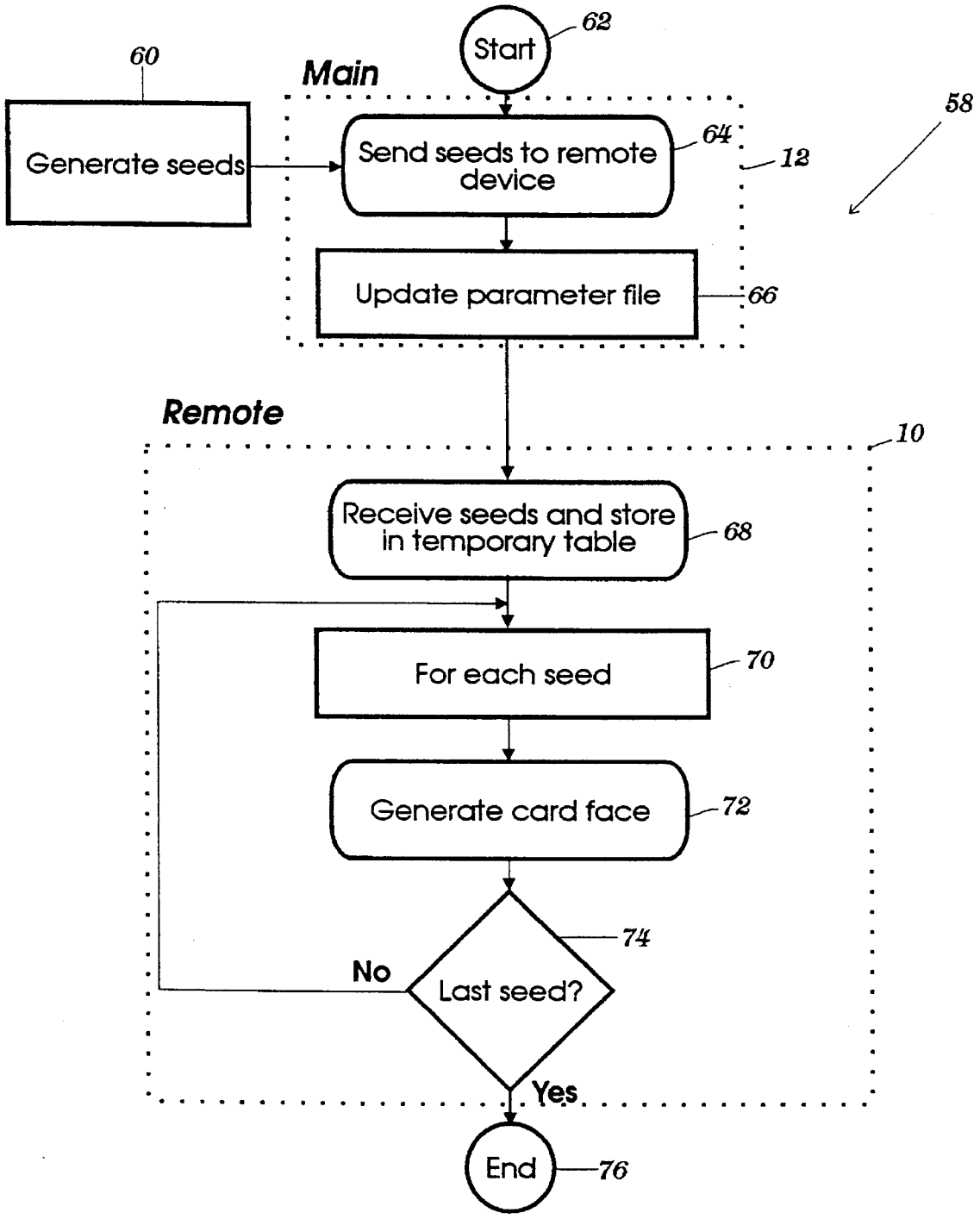
FIG. 3 is a flow chart illustrating, broadly, the steps required to retrieve the stored seeds generated during the process shown in FIG. 1 and, utilizing those seeds, to generate unique card faces in a plurality of remote devices utilizing the process of FIG. 2.

In accordance with the present invention, and with reference to FIGS. 1–3, a process is illustrated for developing a plurality of bingo card faces in the remote device 10 in accordance with input received from the main station 12. Briefly, the process comprises the steps of developing a seed list (a list of unique numbers) in a memory of the main station 12, transferring at least a portion of the seed list to a plurality of the remote devices 10, and creating, at the remote devices 10, bingo card faces (gaming card arrays) utilizing a pseudo-random number generator seeded by the transferred portion of the seed list.

FIG. 1 illustrates the steps taken in a pre-processor 14 that is run to generate the seeds which will, ultimately, be transferred to the remote device 10 or handset. Following the start (16) of the pre-processor 14, a random number generator is initiated (18) to generate a number of seeds (20) which will be utilized to create bingo card faces within the pre-processor 14 itself. Each seed is compared (22) against a seed list to verify that the seed is not a duplicate of a previously created seed. If the seed being examined is not a unique seed, it is discarded, and another seed is then compared (22) against the seed list.

If the seed is unique, a gaming card array or bingo card face is generated (24) in accordance with the process shown in FIG. 2, which will be described hereinafter. The generated card face is then compared (26) with previously generated card faces stored in a card face temporary file. If the card face is not unique, both the seed and the card face are discarded, and the previous process is repeated with respect to a new seed. If, however, the card face is unique, then the seed utilized to create the unique card face is saved (28) in a seed list and the card face is saved (30) in a temporary card face file.

The pre-processor 14 then determines (32) whether or not a sufficient number of seeds have been saved (28) in the seed list, and if not the process is then repeated for a new seed. Once a sufficient number of seeds have been saved (28) in the seed list, then the operation of the pre-processor 14 is terminated (34).

FIG. 2 illustrates the process 36 for generating the gaming card arrays or card faces in both the pre-processor 14 and within the remote device 10. As shown, following the start (38) of the process 36, a pseudo-random number generator is initiated (40) to generate numbers for the twenty-four grid locations on a standard bingo card face. The pseudo-random number generators utilized must always generate the same gaming card array from the same seed. A column is selected (42) and a row is then selected (44) to determine a precise grid location to which a number is assigned (46). As is well known in the art, bingo card faces typically have numbers ranging from either 1 to 75 or 1 to 90. The first column, therefore, is assigned either the numbers 1 through 15 or 1 through 18 (depending on the range of numbers to be utilized), the second column is assigned the numbers 16 through 30 or 17 through 36, and so forth until each of the twenty-four symbol display locations on the game card face are filled. After each number is assigned to a particular grid location, it is compared (48) with previously generated numbers for the same column to verify that there are no duplicate numbers in any one column. If a duplicate number is found, another number is selected and the process of assigning it (46) to a grid square and then comparing it (48) for duplicates is repeated.

If the number assigned to a particular symbol display location is unique, the number is stored in the card array, indexed by row and column (50). The process 36 then seeks to determine whether or not the number stored in the card array was for a symbol display location on the last row (52). If not, the next row is selected (44) and the process repeated. If the last row was selected, then the process 36 determines whether the number was assigned in the last column (54). If not, the next subsequent column is selected (42) and the entire process repeated. Once all of the symbol display locations in each row and column have been filled, the process 36 terminates (56).

FIG. 3 illustrates the process 58 of actually generating the bingo card faces in the handsets or remote devices 10. It will be noted that several of the steps of the process 58 take place in the main station 12, while others take place in the remote devices 10.

Preliminarily, seeds must be generated (60) at the pre-processor 14 and loaded into the memory of the main station 12. On initiation (62) of the process 58, a portion of the seeds stored in the memory of the main station 12 are sent (64) to a remote device 10 from the main station 12, and a parameter file is updated (66) to keep a record of the seeds sent to facilitate generation of unique cards in each remote device. The parameter file may be referred to in order to ensure that duplicate seeds are not sent to any two remote devices 10.

In the remote devices 10, the seeds are received and stored (68) in a temporary table. Seeds are retrieved (70) one at a time in order to generate card faces (72) in accordance with the process shown in FIG. 2. After each card face is generated (72), the process 58 determines (74) whether there are additional seeds stored in the temporary table (68). If there are additional seeds, the process is repeated in order to create a bingo card face for each seed in the temporary table. Once the last seed has been utilized, the process 58 terminates (76).

The sub-routines shown in FIGS. 1–3, taken collectively, illustrate a process for generating a plurality of gaming card arrays, and specifically bingo card faces, each formed of a plurality of symbols positioned in predetermined symbol display locations, wherein the process comprises, broadly, the steps of developing a seed list in a memory of the main station 12, transferring at least a portion of the seed list to a plurality of remote devices 10, and creating, at the remote devices, gaming card arrays utilizing a pseudo-random number generator seeded by the transferred portion of the seed list. The process ensures that seeds transferred to any one remote device 10 do not duplicate the seeds transferred to any other remote device. The developing step includes the creation of a plurality of unique seeds for the seed list utilizing a pseudo-random number generator. More particularly, the pre-processor 14 generates a gaming card array from each unique seed created, verifies that each gaming card array is not a duplicate of a previously generated gaming card array, and saves the seeds resulting in unique gaming card arrays in the seed list.

In the process 58, illustrated in FIG. 3, a temporary table is accessed after each new gaming card array is generated to determine if any unused seed remains in the temporary table. If so, another new gaming card array is generated utilizing the unused seed. A parameter file is updated at the main station 12 to maintain a record of the seeds transferred to each remote device 10. The pseudo-random number generators utilized at the remote devices 10 and in the pre-processor 14 always generate the same gaming card array for any given seed.

Figure 4:
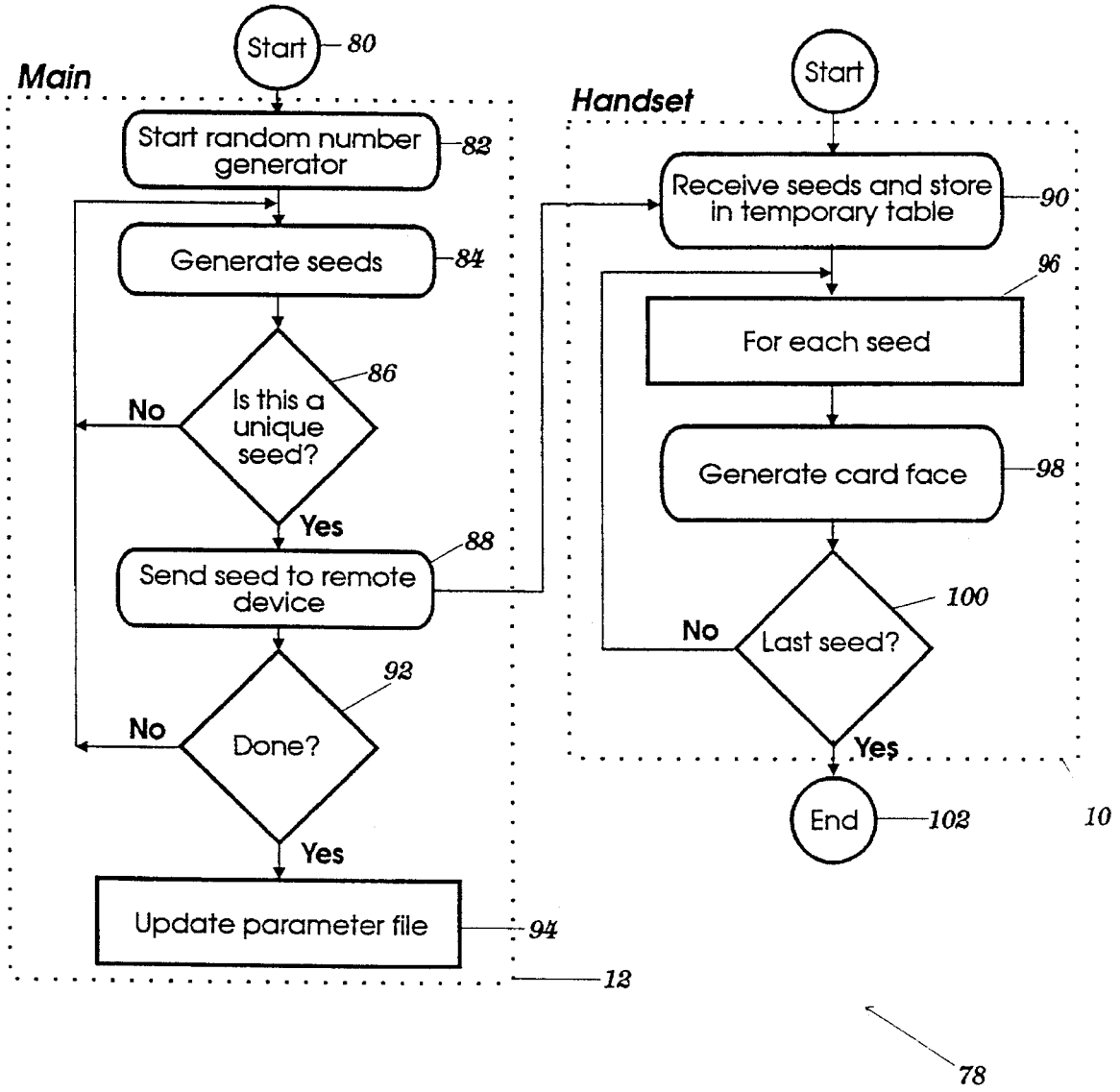
FIG. 4 is a flow chart similar to that shown in FIG. 3, illustrating an alternative process for generating card faces within one or more remote devices utilizing seeds transmitted from a main station.

FIG. 4 illustrates an alternative process 78 similar to the process shown in FIGS. 1–3, with the exception that a pre-processor 14 is not utilized. The process 78 of FIG. 4 utilizes the main station 12 to generate seeds which are transferred immediately to the remote devices 10 for the generation of card faces. The process of generating seeds in the main station 12 only ensures theft the seeds transferred to each handset do not contain duplicates within each remote device 10 itself.

More particularly, the process 78 is initiated (80) through the use of a random number generator (82) that is utilized to generate seeds (84). A parameter file is maintained for purposes of comparing each created seed with a stored seed list in order to determine whether or not the generated seed is unique. Thus, each generated seed is compared (86) with the seed list to verify that it is not a duplicate. If the seed is not unique, it is discarded and another seed is generated and compared with the seed list. If the generated seed is unique, it is sent (88) to a remote device 10 where it is received and stored (90) in a temporary table. The process within the main station 12 then determines (92) if a desired number of seeds have been sent to the remote device 10. If not, a new seed is generated and subjected to the same steps as outlined above. Once the desired number of seeds have been sent, the parameter file is updated (94) in order to maintain a record of the seeds sent to the remote device 10.

Within the remote device 10 the process 78 is nearly identical to that explained above in connection with FIG. 3. For each seed (96) in the temporary table, a card face is generated (98). As each card face is generated (98), the process determines (100) whether or not each of the seeds stored in the temporary table (90) has been utilized. If not, the process is repeated until each seed is utilized to generate a card face. Once each seed has been utilized, the process 78 terminates (102).

Figure 5:
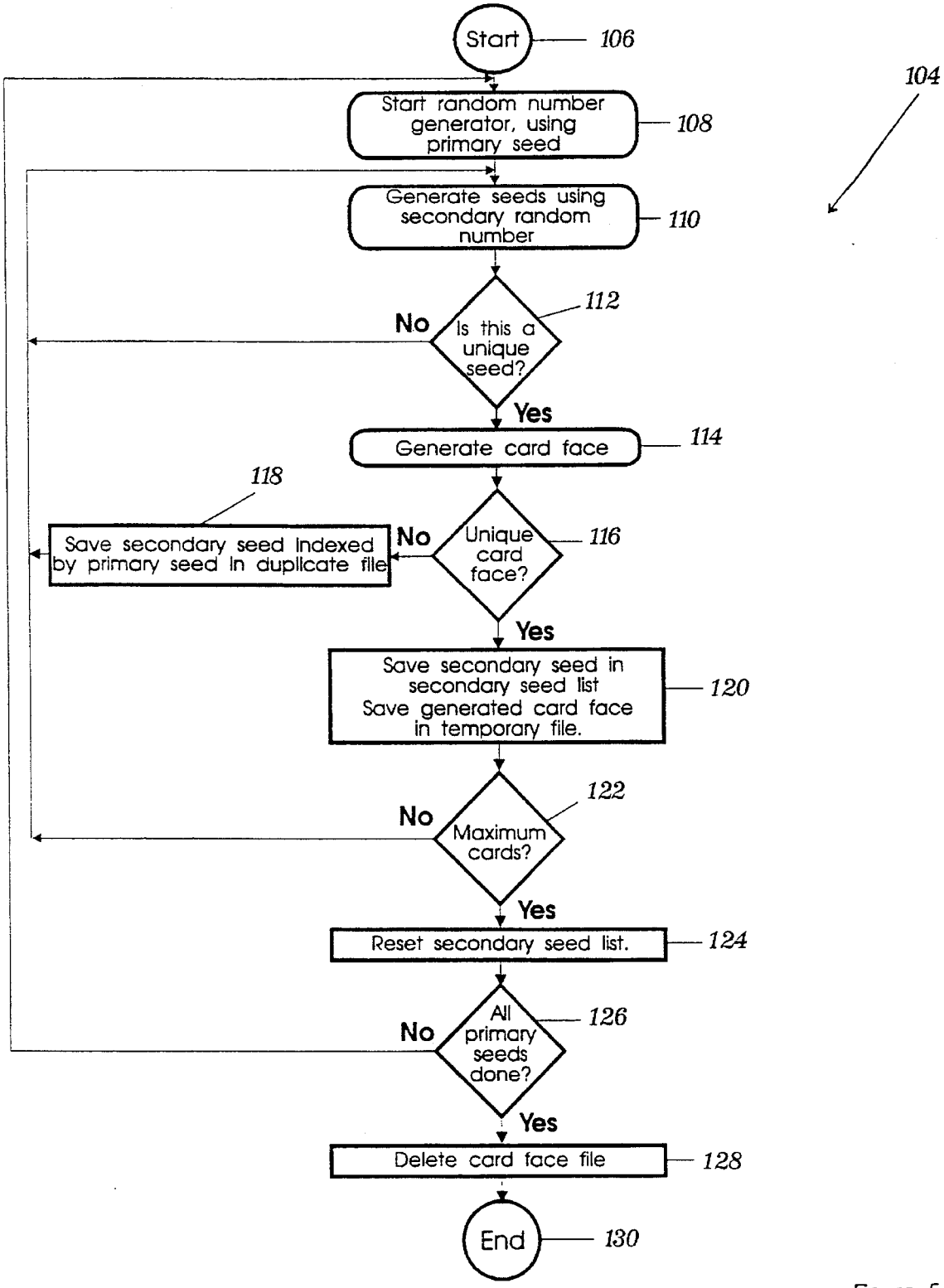
FIG. 5 is a flow chart illustrating the process for developing a duplicate secondary seed list useful in yet another embodiment of the present invention.
Figure 6:
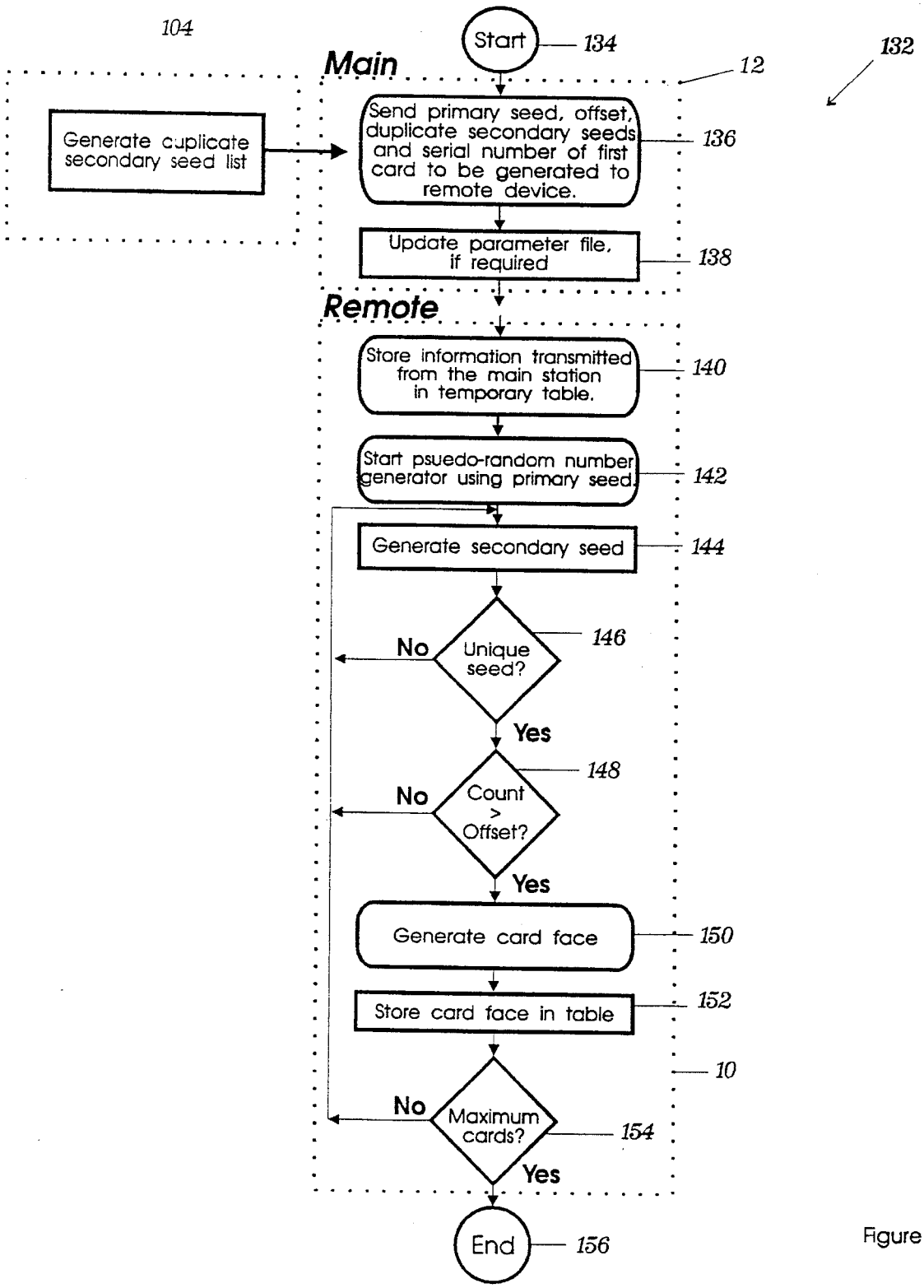
FIG. 6 is a flow chart similar to FIGS. 3 and 4, illustrating the process steps for creating card faces in remote devices in accordance with a third preferred process of the present invention, utilizing the duplicate secondary seed list generated in accordance with the process of FIG. 5.

FIGS. 5 and 6 illustrate another preferred process in accordance with the present invention. This alternative process includes the steps of processing a primary seed to create a list of duplicate secondary seeds, storing the duplicate secondary seed list in the main station 12, sending operational data including the duplicate secondary seed list from the main station 12 to at least one remote device 10, and generating at the at least one remote device 10, gaming card arrays utilizing the primary seed.

FIG. 5 illustrates the process 104 for generating a duplicate secondary seed list. Specifically, after the process 104 is initiated (106), a first random number generator is initiated (108) utilizing a primary seed. The first random number generator generates (110) a plurality of secondary seeds. Each generated secondary seed is compared (112) against a secondary seed list to determine whether or not it is unique. If not, the seed is discarded and the process repeated with another secondary seed. If the seed is unique, however, the gaming card array or card face is generated (114) utilizing the process shown in FIG. 2. The generated card face is compared (116) against previously generated card faces stored in a temporary file. If the card face is not unique, the seed is saved (118) in a duplicate secondary seed list indexed by the primary seed utilized. The process then repeats itself for each new secondary seed generated through the first random number generator. If, however, the card face generated (114) is unique, then the secondary seed is saved (120) in a secondary seed list and the generated card face is saved (120) in a temporary file.

The process 104 then determines (122) whether or not the maximum number of card faces have been generated. If not, the entire process is repeated. If the maximum number of cards have been created, however, the secondary seed list is reset (124) for the primary seed utilized in the first pseudo-random number generator. The process 104 then seeks to determine (126) whether all of the primary seeds have been processed through the first pseudo-random number generator. If not, the process is repeated beginning with utilizing the first random number generator with a new primary seed (108). Once all of the primary seeds have been processed, the card face file is deleted (128), and the process for generating duplicate secondary seed lists terminates (130).

FIG. 6 illustrates the manner in which the gaming card arrays are created within the remote device 10 utilizing the duplicate secondary seed list previously generated (104) and fed to the main station 12. The process 132 of FIG. 6 may be initiated (134) after the duplicate seed list has been transferred to the main station 12. The main station 12 then sends (136) a primary seed, an offset (if required), the duplicate secondary seed list and the serial number of the first card to be generated to the remote device 10. A parameter file is updated (138) to keep a record of the operational data transferred from the main station 12 to the remote device 10.

Within the remote device 10 itself, the operational data is stored (140) in a temporary table. A first pseudo-random number generator is then initiated (142) utilizing the primary seed received from the main station, in order to generate (144) a plurality of secondary seeds. Each secondary seed generated is compared against the duplicate secondary seed list to determine (146) whether it is unique. If not, the seed is discarded and the next secondary seed is selected and so compared. If the generated secondary seed is unique, the process 132 determines (148) whether or not an offset was received from the main station 12 with the operational data, and if so, whether the "count" of the unique seed is greater than the offset value. If not, the seed is discarded and the process repeated. If, however, the "count" is greater than the offset, then the secondary seed is utilized to generate (150) a card face utilizing the same process shown in FIG. 2. After the card face has been generated (150), it is stored (152) in a table. It is next determined (154) whether the maximum number of cards for the remote device 10 have been created. If not, the entire process is repeated until the maximum number of cards have been created. Once the maximum number of cards have been created, the process 132 terminates (156).

The process shown in FIG. 5 illustrates that during the processing step within a pre-processor, a plurality of secondary seeds are created from the primary seed. Each secondary seed is compared against a duplicate secondary seed list to verify that it is not a duplicate of a previously created secondary seed. Each unique secondary seed is saved in a temporary secondary seed list, and thereafter a gaming card array is generated for each non-duplicate secondary seed, which is checked for duplicates. Each unique gaming card array is then saved in a temporary gaming card array file for purposes of developing the duplicate secondary seed list.

With respect to the process of FIG. 6, a first pseudo-random number generator is seeded with the primary seed to create a plurality of secondary seeds. The gaming card arrays are generated utilizing a second pseudo-random number generator seeded by at least a portion of the plurality of secondary seeds. Each secondary seed is compared with the list of duplicate secondary seeds, and all duplicate created secondary seeds are withheld from the second pseudo-random number generator.

In accordance with the one aspect of the invention, the step of seeding the first pseudo-random number generator with a primary seed includes the step of retrieving the primary seed from a memory storage location in the main station 12. Preferably, the primary seed is chosen from a list of prime numbers. In accordance with another aspect of the present invention, the step of seeding the first pseudo-random number generator with a primary seed includes the step of retrieving the primary seed from the at least one remote device. In this regard, preferably the remote device serial number is adopted as the primary seed.

Again with reference to FIG. 6, assuming that the primary seed is to be a prime number, the main station is utilized to send a prime number from a list of prime numbers maintained in the main station 12, an offset value, the starting card serial number and the list of duplicate seeds for this particular prime number. After successful transmission of the operational data to the remote devices, the main station 12 would update its parameter list to indicate which prime number and offset would be sent to the next remote device.

The offset value tells the remote device how many "valid" seeds to skip before starting to use the generated secondary seeds. For example, if each prime number could be used to generate 1,000 cards and a remote device needed only 200 cards, 800 cards would be wasted from each prime number unless an offset were utilized. Through the use of an offset, the same prime number may be utilized until its 1,000 cards are exhausted. For example, the main station 12 would send the prime number and an offset value of "0" to the first remote device 10. The second remote device would receive the same prime number and an offset value of "200". The third remote device would be sent the offset value of "400", and so forth until the full potential of the primary number was realized.

Figure 7:
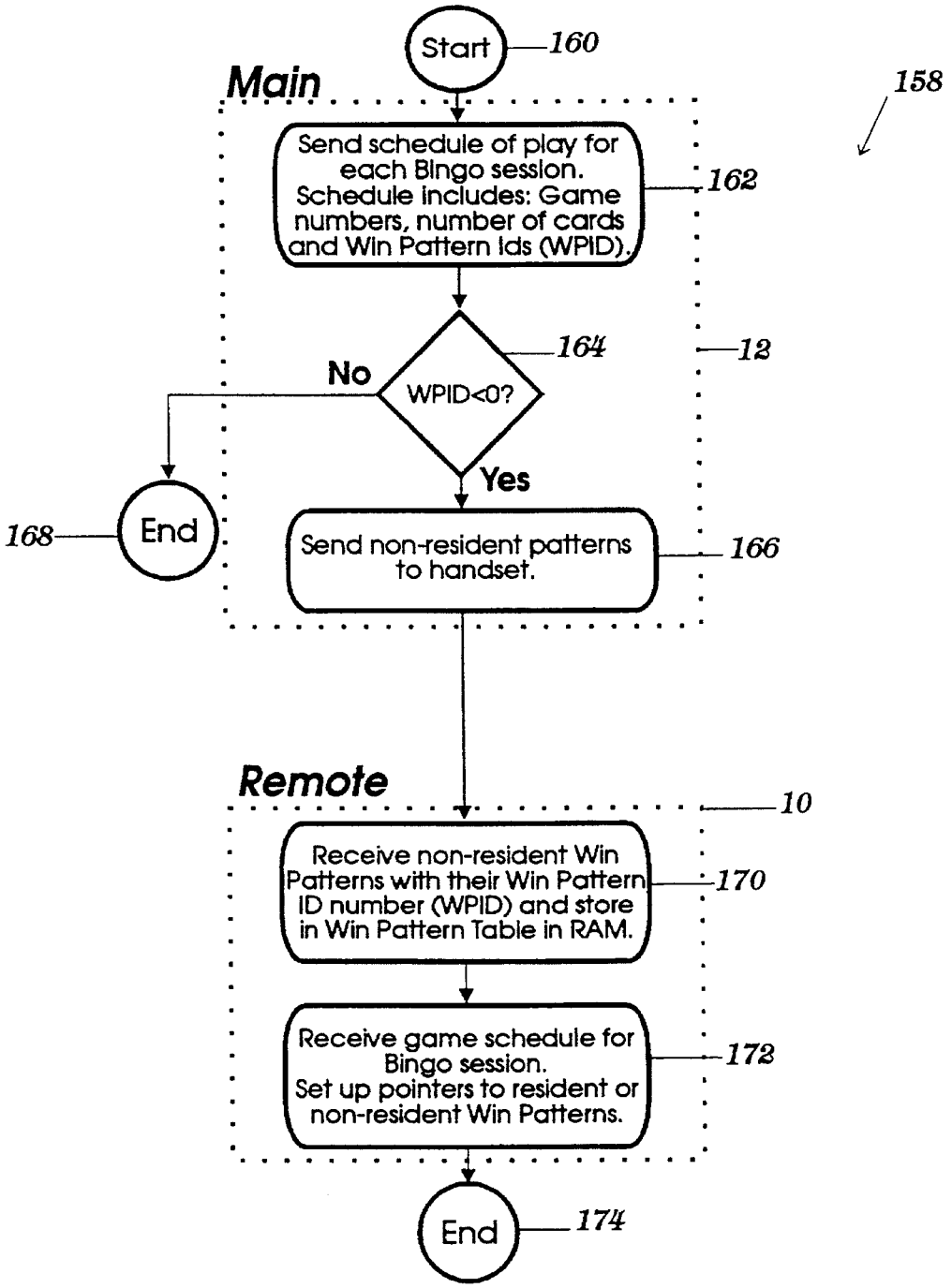
FIG. 7 is a flow chart pertaining to the processing of win patterns, which process steps may be utilized in connection with any of the three preferred embodiments illustrated and described herein.

The process 158 of FIG. 7 pertains to the processing of win patterns. Preferably, the most common win patterns would be compiled into portions of the remote device 10 software that is resident in its ROM (read-only memory). The process 158 is initiated (160) by sending (162) a schedule of play for each bingo session to the remote devices 10. Such a schedule may include game numbers, number of cards and win pattern I.D.s. The main station 12 will then determine (164) if the win patterns are resident in the remote device 10 or are non-resident. If non-resident, then the main station 12 will send (166) the win patterns to the remote device 10. If, on the other hand, the win patterns are resident in the remote devices 10, the process 158 will terminate (168).

In the remote device 10, the non-resident win patterns with their win pattern I.D. numbers are stored (170) in a win pattern table in the random access memory (RAM). The remote device 10 may then receive the game schedule for the bingo session from the main station 12, and will set up a pointer within the remote device to the resident or non-resident win patterns, whichever is applicable (172). The process 158 will then terminate (174).

From the foregoing it is to be appreciated that the present invention provides processes for generating a plurality of gaming card arrays in a remote device 10 connected to a main station 12. The processes either minimize or all-together eliminate the possibility of generating duplicate gaming card arrays in any of the remote devices 10 connected to the main station 12. This is done, in one instance, by running a pre-processor 14 through which a seed list is developed which is capable only of generating unique card faces. In another instance, a duplicate secondary seed list is created for a number of known primary seeds, which secondary seed list is utilized to discard, at a later stage, secondary seeds which may create duplicate gaming card arrays within the remote devices 10. Within any given form of the present invention, several pseudo-random number generators may be utilized to generate seeds and to generate the gaming card arrays within the remote devices 10. The random number generators utilized to generate the gaming card arrays must be identical to one another so as to ensure consistent results throughout the process.

Although several embodiments of the invention have been described in detail for purposes of illustration, various modifications may be made without departing from the spirit and scope of the invention. Accordingly, the invention is not to be limited, except as by the appended claims.

I claim:

1. A process for generating a plurality of gaming card arrays, each formed of a plurality of symbols positioned in predetermined symbol display locations, in a remote device connected to a main station, the steps comprising:

developing a plurality of seeds to be utilized as input for generating gaming card arrays, said developing step including the steps of seeding a first pseudo-random number generator at the main station to create the plurality of seeds, verifying that each seed is not a duplicate of a previously created seed, and sending the plurality of seeds, less duplicates, to the remote device; and generating, at the remote device, gaming card arrays in accordance with input received from the main station utilizing a second pseudo-random number generator seeded by at least a portion of the plurality of seeds, wherein the second pseudo-random number generator always generates the same gaming card array as the first pseudo-random number generator for any given seed.

2. The process of claim 1, including the step of updating a parameter file to maintain a record of which seeds have been used, for utilization during the verifying step.

3. The process of claim 2, including the step of receiving the seeds sent from the main station at the remote device and storing them in a temporary table.

4. The process of claim 3, wherein the generating step includes the steps of accessing the temporary table after each new gaming card array is generated, determining if any unused seed remains in the temporary table and, if so, generating another new gaming card array utilizing the unused seed.

5. The process of claim 4, including the steps of sending a schedule of play from the main station to the remote device, determining if designated win patterns are resident in the remote device, and if the designated win patterns are not resident in the remote device, sending the designated win patterns to the remote device.

6. The process of claim 1, wherein the developing step, prior to the step of sending the seeds, less duplicates, to the remote device, includes the steps of generating a gaming card array from each unique seed created, verifying that each gaming card array is not a duplicate of a previously generated gaming card array, and saving the seeds resulting in unique gaming card arrays in a seed list.

7. The process of claim 6, including the step of saving each unique gaming card array in a temporary file which is accessed during the step of verifying that each gaming card array is not a duplicate of a previously generated gaming card array.

8. The process of claim 6, including the step of retrieving seeds from the seed list prior to the step of sending the seeds to the remote device.

9. A process for generating a plurality of gaming card arrays, each formed of a plurality of symbols positioned in predetermined symbol display locations, in a remote device connected to a main station, the steps comprising:

developing a plurality of seeds to be utilized as input for generating gaming card arrays; and generating, at the remote device, gaming card arrays in accordance with input received from the main station utilizing a random number generator seeded by at least a portion of the plurality of seeds, wherein the generating step includes the steps of seeding a first pseudo-random number generator with a primary seed to create a plurality of secondary seeds, and generating at the remote device gaming card arrays utilizing a second pseudo-random number generator seeded by at least a portion of the plurality of secondary seeds.

10. The process of claim 9, including the steps of processing the primary seed to create a list of duplicate secondary seeds, comparing each created secondary seed with the list of duplicate secondary seeds, and withholding all duplicate created secondary seeds from the second pseudo-random number generator.

11. The process of claim 10, including the steps of sending operational data including the duplicate secondary seed list from the main station to the remote device, updating a parameter file to record the quantity of gaming card arrays to be generated in the remote device, and storing the operational data in a temporary table at the remote device.

12. The process of claim 11, including the step of withholding from the second pseudo-random number generator a number of the unique created secondary seeds corresponding to an offset sent to the remote device with the operational data.

13. The process of claim 9, including the step of storing the gaming card arrays created at the remote device in a gaming card array table.

14. The process of claim 9, wherein the step of seeding the first pseudo-random number generator with the primary seed, includes the step of retrieving the primary seed from a memory storage location in the main station.

15. The process of claim 14, including the step of choosing the primary seed from a list of prime numbers.

16. The process of claim 9, wherein the step of seeding the first pseudo-random number generator with the primary seed, includes the step of retrieving the primary seed from the remote device.

17. The process of claim 16, including the step of adopting a remote device serial number as the primary seed.

18. The process of claim 10, wherein the processing step includes the steps of creating secondary seeds, verifying that each secondary seed is not a duplicate of a previously created secondary seed, generating a gaming card array for each non-duplicate secondary seed, checking each gaming card array for duplicates, and forming the list of duplicate secondary seeds.

19. The process of claim 18, including the steps of saving each unique secondary seed in a temporary secondary seed list, and saving each unique gaming card array in a temporary gaming card array file.

20. The process of claim 9, including the steps of sending a schedule of play from the main station to the remote device, determining if designated win patterns are resident in the remote device, and if the win patterns are not resident in the remote device, sending the designated win patterns to the remote device.

21. A process for generating a plurality of gaming card arrays, each formed of a plurality of symbols positioned in predetermined symbol display locations, the steps comprising:

developing a seed list in a memory of a main station, wherein the developing step includes the steps of seeding a first pseudo-random number generator at the main station to create a plurality of seeds for the seed list, and verifying that each seed is not a duplicate of a previously created seed;

transferring at least a portion of the seed list to a plurality of remote devices; and creating, at the remote devices, gaming card arrays utilizing a second pseudo-random number generator seeded by the transferred portion the seed list, wherein the first and second pseudo-random number generators always generate the same gaming card array for any given seed.

22. The process of claim 21, wherein the transferring step includes the step of ensuring that seeds transferred to any one remote device do not duplicate the seeds transferred to any other remote device.

23. The process of claim 22, wherein the developing step includes the steps of generating a gaming card array from each unique seed created, verifying that each gaming card array is not a duplicate of a previously generated gaming card array, and saving the seeds resulting in unique gaming card arrays in the seed list.

24. The process of claim 23, including the step of saving each unique gaming card array in a temporary file which is accessed during the step of verifying that each gaming card array is not a duplicate of a previously generated gaming card array.

25. The process of claim 22, including the steps of updating a parameter file at the main station to maintain a record of the seeds transferred for utilization during the ensuring step, and storing the portion of the seed list transferred to each remote device in a temporary table.

26. The process of claim 25, wherein the creating step includes the steps of accessing the temporary table after each new gaming card array is generated, determining if any unused seed remains in the temporary table and, if so, generating another new gaming card array utilizing the unused seed.

27. The process of claim 26, including the steps of sending a schedule of play from the main station to the remote devices, determining if designated win patterns are resident in the remote devices, and if the win patterns are not resident in the remote devices, sending the designated win patterns to the remote devices.

28. A process for generating a plurality of gaming card arrays, each formed of a plurality of symbols positioned in predetermined symbol display locations, the steps comprising:

processing a primary seed to create a list of duplicate secondary seeds;

storing the duplicate secondary seed list in a main station;

sending operational data including the duplicate secondary seed list, from the main station to at least one remote device; and generating at the at least one remote device, gaming card arrays utilizing the primary seed, wherein the generating step includes the steps of seeding a first pseudo-random number generator with the primary seed to create a plurality of secondary seeds, and generating the gaming card arrays utilizing a second pseudo-random number generator seeded by at least a portion of the plurality of secondary seeds.

29. The process of claim 28, wherein the processing step includes the steps of creating a plurality of secondary seeds from the primary seed, verifying that each secondary seed is not a duplicate of a previously created secondary seed, saving each unique secondary seed in a temporary secondary seed list, generating a gaming card array for each non-duplicate secondary seed, checking each gaming card array for duplicates, and saving each unique gaming card array in a temporary gaming card array file.

30. The process of claim 28, including the steps of sending a schedule of play from the main station to the at least one remote device, determining if designated win patterns are resident in the at least one remote device, and if the win patterns are not resident in the at least one remote device, sending the designated win patterns to the at least one remote device.

31. The process of claim 28, including the steps of comparing each created secondary seed with the list of duplicate secondary seeds, and withholding all duplicate created secondary seeds from the second pseudo-random number generator.

32. The process of claim 31, wherein the sending step includes the step of sending an offset, if required, from the main station to the remote device, and wherein the generating step includes the step of withholding from the second pseudo-random number generator a number of the unique created secondary seeds corresponding to the offset sent to the remote device with the operational data.

33. The process of claim 28, including the steps of updating a parameter file to record the quantity of gaming card arrays to be generated in the at least one remote device, and storing the gaming card arrays created at the at least one remote device in a gaming card array table.

34. The process of claim 28, wherein the step of seeding the first pseudo-random number generator with the primary seed includes the step of retrieving the primary seed from a memory storage location in the main station.

35. The process of claim 34, including the step of choosing the primary seed from a list of prime numbers.

36. The process of claim 28, wherein the step of seeding the first pseudo-random number generator with the primary seed includes the step of retrieving the primary seed from the at least one remote device.

37. The process of claim 36, including the step of adopting a remote device serial number as the primary seed.

* * * * *